United States Patent [19]

Clarke

[11] 4,029,444

[45] June 14, 1977

[54] SEALING BOLT SEAT FOR ROTARY PISTON MACHINE

[75] Inventor: John Michael Clarke, Banbury, England

[73] Assignee: Caterpillar Tractor Co., Peoria, Ill.

[22] Filed: Oct. 10, 1975

[21] Appl. No.: 621,430

[30] Foreign Application Priority Data

Oct. 10, 1974 United Kingdom ..... 43855/74

[52] U.S. Cl. ..... 418/120; 418/51

[51] Int. Cl.[2] ..... F01C 19/08

[58] Field of Search ..... 418/119, 120, 121, 122, 418/123, 124, 142, 51

[56] References Cited

UNITED STATES PATENTS

| | | | |
|---|---|---|---|
| 3,485,218 | 12/1969 | Clarke | 418/53 |
| 3,830,600 | 8/1974 | Shimoji et al. | 418/122 X |

*Primary Examiner*—Carlton R. Croyle
*Assistant Examiner*—Leonard Smith
*Attorney, Agent, or Firm*—Gifford, Chandler, Sheridan & Sprinkle

[57] ABSTRACT

A rotary piston machine of the type having a slant or precessing rotor or the type having a parallel axis rotor, such as a Wankel engine, having a rotor seal grid formed from peripheral and apex seals which are connected together at their adjacent ends by connectors, often called bolts, located in sockets in the rotor. An arcuate seal extends peripherally around each bolt in the manner of a piston ring between the peripheral surface of the bolt and the adjacent peripheral wall of the socket in which the bolt is located, to effect sealing between the peripheral walls of the bolt and the socket without inhibiting relative movement of the bolt in the socket.

3 Claims, 6 Drawing Figures

SEALING BOLT SEAT FOR ROTARY PISTON MACHINE

BACKGROUND OF THE INVENTION

The invention relates to a rotary piston machine, which term includes an internal combustion engine, pump or compressor of either the type having a slant axis or precessing rotor or the type having a parallel axis rotor, the Wankel engine being an example of the latter type.

In either type of machine, the rotor carries a grid of seals which engage internal walls of the housing in which the rotor rotates and which define therein separated working chambers. The portion of the grid bounding each working chamber is usually formed from a plurality of apex seals spaced apart around the rotor axis in a general circumferential direction of the rotor and a plurality of peripheral seals spaced apart in a general direction axially of the rotor. Co-operating peripheral and apex seals are connected together at their adjacent ends by engaging in slots in a connector often called a link block or bolt (and hereinafter called a "bolt") inserted into a socket in the rotor. Although effective sealing is performed between the seals themselves by slotting the circumferential and apex seals in the bolts, there is nevertheless a significant leakage path around each bolt and the wall of its socket. An object of the invention is to provide secondary sealing to reduce leakage around the bolts.

SUMMARY OF THE INVENTION

According to the invention, a rotary piston machine having a rotor seal grid comprising a plurality of peripheral and apex seals which are connected together at their adjacent ends by a bolt, as herein before defined, located in a socket in the rotor, also includes an arcuate seal extending peripherally around the bolt and engaging in the manner of a piston ring between the peripheral surface thereof and the adjacent peripheral wall of the socket in which the bolt is located, whereby sealing is effected between the peripheral walls of the bolt and the socket without inhibiting relative movement of the bolt in the socket.

Conveniently the arcuate seal is located in a circumferentally-extending slot in the peripheral surface of the bolt and extends therefrom into engagement at its outer periphery with the adjacent peripheral wall of the socket, the arcuate seal being resilient whereby eccentric movement of the bolt in the socket is permitted.

The invention also includes a rotor having a rotor seal grid for a rotary piston machine as set out in either of the two immediately preceeding paragraphs.

BRIEF DESCRIPTION OF THE DRAWINGS

By way of example, a seal arrangement in accordancce with the invention is now described with reference to the accompanying drawings, in which.

DESCRIPTION OF THE PREFERRED EMBODIMENT

Figure 1:
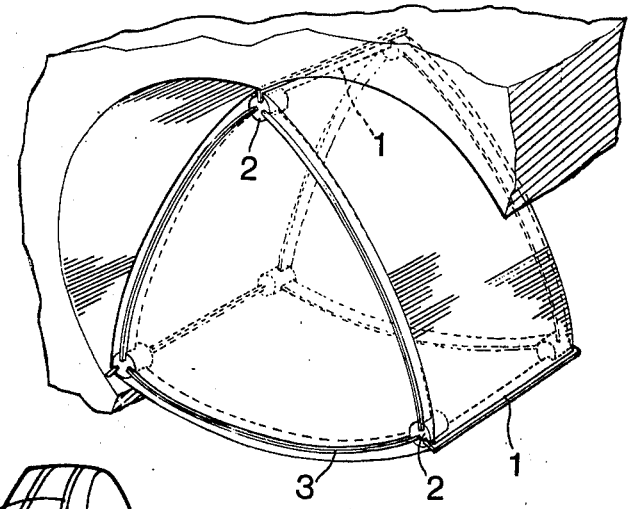
FIG. 1 is a diagram showing a typical known arrangement of seals for a rotary piston engine of the parallel axis rotor or Wankel type.

Referring first to FIG. 1, the typical seal arrangement in a rotary piston engine of the Wankel type includes three apex seals 1 mounted one at each of the three corners of the rotor and extending along the edge of the corner and parallel with the axis of rotation of the rotor. The apex seals are slotted into the edges of the corners of the rotor and into bolts 2 of generally cylindrical shape located in sockets in the rotor at each corner and adjacent the end faces. The seal arrangement is completed by peripheral seals 3 mounted on the periphery of the rotor and extending between the apex seals. A sealing grid is formed around the rotor by the apex seals 1, the peripheral seals 3 and the bolts 2. The radially outer edges of the apex seals 1 and the outer faces of the peripheral seals 3 engage the internal walls of the housing in which the rotor is mounted and thus define in the housing separated working chambers as the rotor turns therein.

Figure 2:
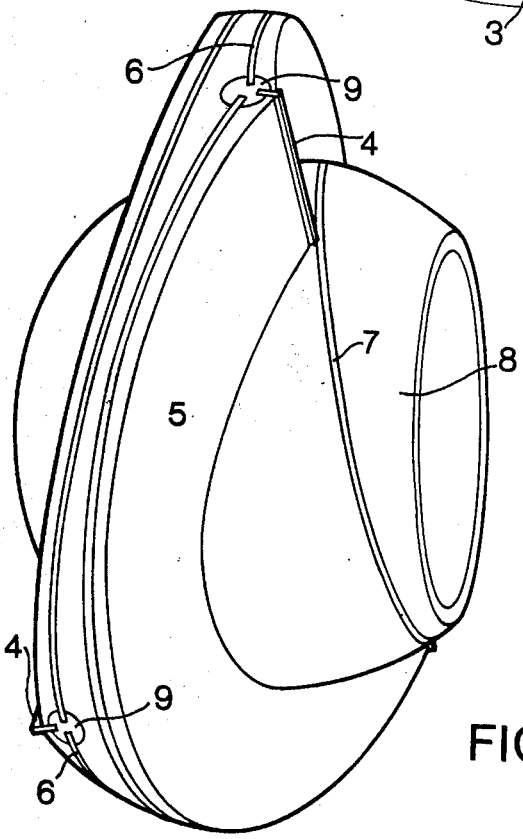
FIG. 2 is a diagram showing a typical known arrangement of seals for a rotary piston engine of the slant axis or precessing rotor type.

Referring now to FIG. 2, the typical seal arrangement in a rotary piston engine of the type having a slant or precessing rotor axis comprises a grid formed from apex seals 4 slotted in the rotor 5, peripheral seals 6 extending along the rim of the rotor and peripheral seals 7 extending along the hub 8 of the rotor, the latter being of spherical shape. As in the Wankel engine the apex seals 4 and the peripheral seals 6 are slotted into bolts indicated at 9 located in sockets in the rotor.

In either arrangement, the seal grid does not provide complete sealing as there is a leakage path around each bolt 2 or 9, as the latter must have some clearance in its socket to accommodate changes in inclination of the apex seals 1 or 4 arising from differential thermal expansion and manufacturing tolerances.

Figure 4:
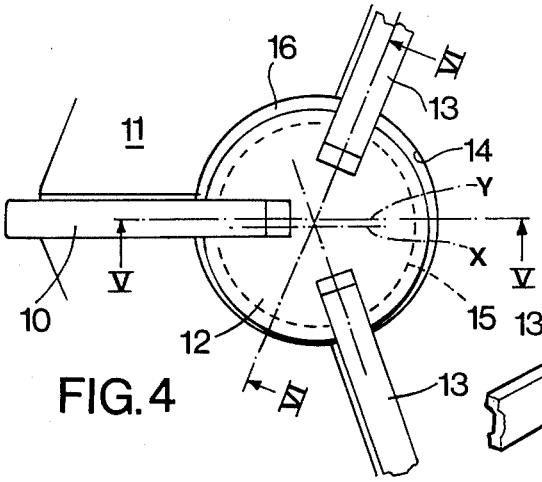
FIG. 4 is an end view of the bolt shown in FIG. 3.
Figure 3:
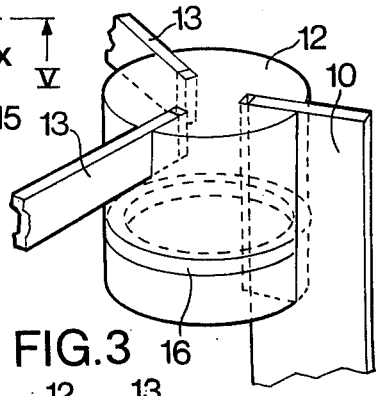
FIG. 3 is a perspective view to a larger scale than in FIGS. 1 or 2 of a seal bolt (as hereinbefore defined) at a corner of the seal arrangement in accordance with the present invention.
Figure 5:
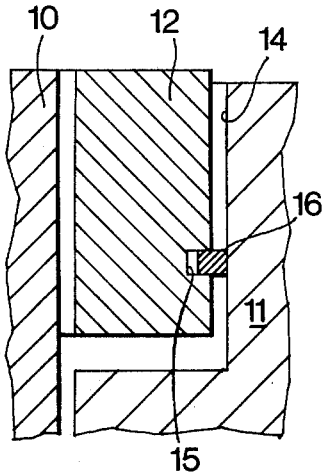
FIG. 5 is a section on the line V-V in FIG. 4.
Figure 6:
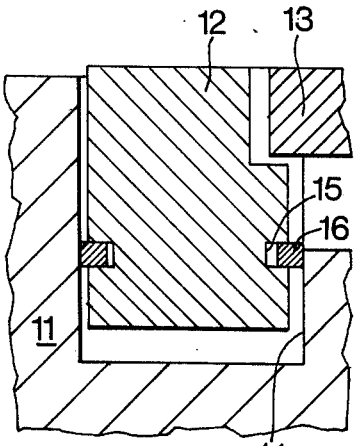
FIG. 6 is a section on the line VI-VI in FIG. 4.

In accordance with the invention, a seal arrangement at each corner of a rotor in an engine of either of the foregoing types is shown in FIG. 3. The seal arrangement comprises an apex seal 10 (equivalent to 1 or 4 in FIGS. 1 and 2 respectively) slotted into the rotor 11 and into a cylindrical bolt 12. The apex seal 10 has freedom to move sideways in the slot in the rotor and also to move radially in the slot in the bolt 12. A pair of peripheral seals 13 (equivalent to 3 or 6 in FIGS. 1 and 2 respectively) are similarly slotted in the rotor 11 and the bolt 12. To permit the change in inclination of the apex seal 10, the bolt 12 is a loose fit in its socket 14 and thus the bolt 12 can wobble eccentically in its socket and also wobble from side-to-side as indicated by the transverse centre-line X of the bolt 12 being offset from the centre-line Y of the apex seal 10. (See FIG. 4). To prevent or to reduce leakage around the periphery of the bolt 12, the latter is provided with a peripheral slot 15, like that in a piston of a conventional internal combustion engine and the slot 15 is fitted with an arcuate resilient seal 16 like a conventional piston ring (See FIGS. 3, 4, 5 and 6). The outer peripheral surface of the seal 16 engages the peripheral surface of the socket 14 and as the seal 16 is arcuate and resilient and can move freely in the slot 15 in the radial and circumferential directions thereof, the seal 16 will remain in engagement with the socket 14 and will permit the wobble movement of the bolt 12 in the socket 14. As shown in FIGS. 3 and 6, the seal is positioned inboard, with respect to the socket 14, of the peripheral seals 13 and so a complete seal around the bolt 12 is produced by the seal 16 except immediately adjacent the apex seal 10, where the ends of the seal 16 are spaced from the sides of the apex seal 10 to allow the apex seal 10 to pass through the slot in the bolt 12 in the longitudinal direction thereof and to allow the seal 16 to expand and contract in the circumferential direction thereof.

The provision of the seal 16 enables the bolt 12 and the socket 14 to be made with greater diametral tolerances than hitherto.

As for conventional internal combustion engine pistons, a plurality of seals 16 may be provided one behind the other in the axial direction of the bolt 12 and separated by lands. In this way more effective sealing can be produced.

The provision of the seal or seals 16 enables thermal expansion of the rotor, bolts and seals to be accommodated.

Although the foregoing description refers to an internal combustion engine, a similar sealing arrangement may be employed in a rotary piston machine in which there is no combustion, for example, in a compressor or a pump.

What I claim as my invention and desire to secure by Letters Patent of the United States is:

1. A rotary piston machine having a rotor seal grid comprising a plurality of peripheral and apex seals and a cylindrical seal connector (herein called a "bolt") with which ends of said peripheral and apex seals engage, said bolt located with lateral clearance in a socket in the rotor, and having a circumferentially-extending slot in its circumferential surface, said seal grid also including an arcuate resilient seal located in said slot and extending circumferentially around said slot and engaging between the circumferential wall of said slot and the adjacent circumferential wall of the socket, whereby sealing is effected between the circumferential walls of the slot and the socket while permitting lateral movement and wobbling of said bolt in the socket.

2. A rotary piston machine of the type having either a slant axis or precessing rotor or a parallel axis rotor, the rotor having thereon a seal grid comprising peripheral seals extending along a first surface of the rotor and apex seals extending along a second surface of the rotor transverse to said first surface, a plurality of peripheral and apex seals co-operating with one another to define a closed working chamber in a housing in which the rotor is rotatable, the seal grid also including a plurality of cylindrical connectors forming bolts, each inserted into a respective socket formed in the rotor, each said bolt having at least one peripheral seal engaged in a generally-radially-extending slot formed in the outer end face of said bolt and an apex seal engaged in an axially-extending slot in the peripheral surface of said bolt, and each said bolt also including a resilient arcuate seal located in a circumferentially-extending slot in the circumferential surface of said bolt and extending peripherally around said bolt in engagement between the peripheral surface of said circumferentially-extending slot and the peripheral wall of the respective socket in which said bolt is located, said arcuate seal positioned nearer to the inner end of said bolt with respect to the socket than said peripheral seal, circumferentially-spaced ends of said arcuate seal positioned one on each side of said apex seal.

3. A rotor for a rotary piston machine having thereon a seal grid comprising peripheral seals extending along a first surface of the rotor and apex seals extending along a second surface of the rotor transverse to said first surface, a plurality of peripheral and apex seals co-operating with one another to define a closed working chamber in a housing in which the rotor is rotatable, said seal grid also including a plurality of cylindrical connectors forming bolts, each inserted into a respective socket formed in the rotor, each said bolt having at least one peripheral seal engaged in a generally radially-extending slot formed in the outer end face of said bolt and an apex seal engaged in an axially-extending slot in the peripheral surface of said bolt, and each said bolt also including a resilient arcuate seal located in a circumferentially-extending slot in the circumferential surface of said bolt and extending peripherally around said bolt in engagement between the peripheral surface of said circumferentially-extending slot and the peripheral wall of the respective socket in which said bolt is located, said arcuate seal being positioned nearer to the inner end of said bolt with respect to the socket than said peripheral seal, circumferentially-spaced ends of said arcuate seal being positioned one on each side of said apex seal.

* * * * *